US010777132B2

(12) United States Patent
Qing

(10) Patent No.: US 10,777,132 B2
(45) Date of Patent: Sep. 15, 2020

(54) DISPLAY DEVICE, DISPLAY PANEL, PIXEL DRIVING CIRCUIT AND DRIVING METHOD

(71) Applicants: BOE TECHNOLOGY GROUP CO., LTD., Beijing (CN); Chengdu BOE Optoelectronics Technology Co., Ltd., Sichuan Province (CN)

(72) Inventor: Haigang Qing, Beijing (CN)

(73) Assignees: BOE TECHNOLOGY GROUP CO., LTD., Beijing (CN); CHENGDUE BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 389 days.

(21) Appl. No.: 15/768,899

(22) PCT Filed: Sep. 29, 2017

(86) PCT No.: PCT/CN2017/104597
§ 371 (c)(1),
(2) Date: Apr. 17, 2018

(87) PCT Pub. No.: WO2018/161553
PCT Pub. Date: Sep. 13, 2018

(65) Prior Publication Data

US 2020/0265780 A1 Aug. 20, 2020

(30) Foreign Application Priority Data

Mar. 6, 2017 (CN) ..... 2017 1 0128154

(51) Int. Cl.
*G09G 5/00* (2006.01)
*G09G 3/3233* (2016.01)

(52) U.S. Cl.
CPC ... *G09G 3/3233* (2013.01); *G09G 2300/0426* (2013.01); *G09G 2310/0213* (2013.01); *G09G 2320/0233* (2013.01)

(58) Field of Classification Search
CPC ..... G09G 3/3233; G09G 3/3241; G09G 2320/0233; G09G 2310/0213; G09G 2300/0426
See application file for complete search history.

(56) References Cited

U.S. PATENT DOCUMENTS 8,077,126 B2 12/2011 Lee et al.
9,450,040 B2 9/2016 Kim et al.
(Continued)

FOREIGN PATENT DOCUMENTS

CN 103489395 A 1/2014
CN 103578426 A 2/2014
(Continued)

OTHER PUBLICATIONS

First Office Action for Chinese Patent Application No. 201710128154.2 dated Feb. 27, 2019.
(Continued)

*Primary Examiner* — Adam R. Giesy
(74) *Attorney, Agent, or Firm* — Calfee, Halter & Griswold LLP

(57) ABSTRACT

The present disclosure provides a display device, a display panel and a pixel driving circuit. The pixel driving circuit includes a driving transistor, a first scanning terminal, a second scanning terminal, a data input terminal, a light emission control terminal, a storage capacitor, a reset unit, and a write compensation unit and a light emission control unit, wherein the reset unit is turned on according to a first scanning signal from the first scanning terminal to reset the storage capacitor and charge the storage capacitor; and the
(Continued)

writing compensation unit is turned on according to a second scanning signal from the second scanning terminal, to cause data signals provided by the data input terminal to be written into a gate electrode of the driving transistor, and to cause the storage capacitor to be discharged through the writing compensation unit and the driving transistor until the driving transistor is turned off.

13 Claims, 5 Drawing Sheets

(56) References Cited

U.S. PATENT DOCUMENTS

| | | | |
|---|---|---|---|
| 9,660,012 | B2 | 5/2017 | Kim et al. |
| 2010/0079361 | A1 | 4/2010 | Lee et al. |
| 2014/0034923 | A1 | 2/2014 | Kim et al. |
| 2016/0358995 | A1 | 12/2016 | Kim et al. |
| 2017/0213506 | A1* | 7/2017 | Shibusawa ..... G09G 3/3233 |
| 2017/0229056 | A1 | 8/2017 | Li et al. |
| 2017/0256601 | A1 | 9/2017 | Kim et al. |

FOREIGN PATENT DOCUMENTS

| | | | |
|---|---|---|---|
| CN | 103778889 | A | 5/2014 |
| CN | 104537983 | A | 4/2015 |
| CN | 105206222 | A | 12/2015 |
| CN | 105528997 | A | 4/2016 |
| CN | 106297663 | A | 1/2017 |
| CN | 106782286 | A | 5/2017 |
| EP | 2693481 | A2 | 2/2014 |
| EP | 2693482 | A2 | 2/2014 |

OTHER PUBLICATIONS

International Search Report and Written Opinion from PCT/CN2017/104597 dated Dec. 28, 2017.

Second Office Action for Chinese Patent Application No. 201710128154.2 dated Aug. 9, 2019.

* cited by examiner

DISPLAY DEVICE, DISPLAY PANEL, PIXEL DRIVING CIRCUIT AND DRIVING METHOD

CROSS REFERENCE TO RELATED APPLICATIONS

This application claims the benefit of China Patent Application No. 201710128154.2 filed with the China Patent Office on Mar. 6, 2017, the entire content of which is hereby incorporated by reference.

TECHNICAL FIELD

The present disclosure relates to the field of display technology, and in particular, to a pixel driving circuit, a display panel, a display device and a driving method.

BACKGROUND

Regardless of whether the related display device adopts an LTPS (Low Temperature Poly-silicon) process or an Oxide process, due to inhomogeneity of the processes, a difference in threshold voltage between driving transistors in different positions may occur, and thus light emission of pixels in different positions may be affected, resulting in display unevenness.

In the related art, the threshold voltage of the driving transistor is usually compensated by the pixel driving circuit itself to solve the problem of display unevenness caused by unevenness of the threshold voltages. However, the related art has the problem that both the P-type transistors and the N-type transistors exist in the circuit, resulting in complicated process and increased costs. If the transistors are all changed to P-type transistors, then it is necessary to increase control signals to meet the requirements of the circuit, which will further complicate the design of the peripheral circuit.

SUMMARY

The present disclosure aims to solve at least to some extent one of the technical problems in the related art. Therefore, an object of the present disclosure is to provide a pixel driving circuit that maintains the simplification of the circuit control signal as much as possible while ensuring a simple manufacturing process. A further object of the present disclosure to provide a method for driving a pixel.

Another object of the present disclosure is to provide a display panel. Yet another object of the present disclosure is to provide a display device.

In order to achieve the above objects, one aspect of the embodiments of the present disclosure provide a pixel driving circuit, including a driving transistor, a first scanning terminal, a second scanning terminal, a data input terminal, a light emission control terminal, a storage capacitor, a reset unit, a writing compensation unit, and a light emission control unit, wherein, the storage capacitor is connected to the driving transistor; the reset unit is connected to the first scanning terminal, and the reset unit is turned on according to a first scanning signal provided by the first scanning terminal, to reset the storage capacitor and charge the storage capacitor; the writing compensation unit is respectively connected to the second scanning terminal and the data input terminal, and the writing compensation unit is turned on according to a second scanning signal provided by the second scanning terminal, to cause data signals provided by the data input terminal to be written into a gate electrode of the driving transistor, and to cause the storage capacitor to be discharged through the writing compensation unit and the driving transistor until the driving transistor is turned off; the light emission control unit is connected to the light emission control terminal, the light emission control unit is turned on according to a light emission control signal provided by the light emission control terminal, to cooperate with the storage capacitor to drive the driving transistor to generate a light emitting current for driving the light emitting element in the pixel to emit light; and wherein the first scanning signal is outputted before the second scanning signal.

According to the pixel driving circuit provided by the embodiment of the present disclosure, the reset unit is turned on according to the first scanning signal provided by the first scanning terminal to reset the storage capacitor and charge the storage capacitor. The writing compensation unit is turned on according to the second scanning signal provided by the second scanning terminal, to cause the data signals provided by the data input terminal to be written into the gate electrode of the driving transistor and to cause the storage capacitor to be discharged through the writing compensation unit and the driving transistor until the driving transistor is turned off. The light emitting control unit is turned on according to a light emitting control signal provided by the light emitting control terminal, to drive the driving transistor together with the storage capacitor, to generate a light emitting current for driving the light emitting element in the pixel to emit light. Further, the first scanning signal is outputted before the second scanning signal. Therefore, it can eliminate the influence of the voltage threshold of the driving transistor on the display evenness. The simple manufacturing process can be ensured while simple control signals for the circuit can be maintained as far as possible.

According to one embodiment, one terminal of the storage capacitor is connected to the second electrode of the driving transistor, and the light emission control unit includes a first transistor and a second transistor, a gate electrode of the first transistor is connected to the light emission control terminal, a second electrode of the first transistor is connected to a first preset power supply, and a first electrode of the first transistor is connected to a second electrode of the driving transistor, a gate electrode of the second transistor is connected to the light emission control terminal, a first electrode of the second transistor is connected to the other terminal of the storage capacitor, and a second electrode of the second transistor is connected to the gate electrode of the driving transistor.

According to one embodiment, the reset unit shares the first transistor with the light emission control unit, the reset unit further includes a third transistor, a gate electrode of the third transistor is connected to the first scanning terminal, a first electrode of the third transistor is connected to a second preset power supply, and a second electrode of the third transistor is connected to one terminal of the storage capacitor.

According to one embodiment, the writing compensation unit includes a fourth transistor and a fifth transistor, a gate electrode of the fourth transistor is connected to the second scanning terminal, a first electrode of the fourth transistor is connected to the second preset power supply, a second electrode of the fourth transistor is connected to one terminal of the storage capacitor, a gate electrode of the fifth transistor is connected to the second scanning terminal, a fifth electrode of the fifth transistor is connected to the data input terminal, and a second electrode of the fifth transistor is connected to the gate electrode of the driving transistor.

According to one embodiment, each of the first transistor, the second transistor, the third transistor, the fourth transistor, and the fifth transistor is a P-type transistor.

According to one embodiment, operation stages of the pixel driving circuit sequentially includes a reset stage, a writing compensation stage, and a light emitting driving stage, wherein in the reset stage, the first scanning signal and the light emission control signal are at low levels and the second scanning signal is at a high level, the first transistor, the second transistor and the third transistor are turned on, the fourth transistor and the fifth transistor are turned off, the second preset power supply resets the storage capacitor through the third transistor, and the first preset power supply charges the storage capacitor through the first transistor; in the writing compensation stage, the first scanning signal and the light emission control signal are at high levels, the second scanning signal is at a low level, the first transistor, the second transistor, and the third transistor are turned off, the fourth transistor and the fifth transistor are turned on, the data signal is written into the gate electrode of the driving transistor through the fifth transistor, and the storage capacitor is discharged through the driving transistor until the driving transistor is turned off; and in the light emitting driving stage, the first scanning signal and the second scanning signal are at high levels, and the light emission control signal is at a low level, the first transistor and the second transistor are turned on, the third transistor, the fourth transistor and the fifth transistor are turned off, and the driving transistor generates the light emitting current under the action of the storage capacitor.

According to one embodiment, the operation stages further includes a buffering stage between the writing compensation stage and the light emitting driving stage, wherein in the buffering stage, the first scanning signal, the second scanning signal, and the light emission control signal are at high levels, and the first transistor, the second transistor, the third transistor, the fourth transistor and the fifth transistor are turned off to suppress interference.

According to one embodiment, in the writing compensation stage, a falling edge of the second scanning signal and a rising edge of the light emission control signal are simultaneously provided to the second scanning terminal and light emission control terminal.

To achieve the above objects, another aspect of the embodiments of the present disclosure provides a display panel including the pixel driving circuit.

To achieve the above objects, another aspect of the embodiments of the present disclosure provides a display device including the display panel.

To achieve the above objects, another aspect of the embodiments of the present disclosure provides a method for driving a pixel with the pixel driving circuit of claim 4 including: a reset stage, in which the first scanning signal and the light emission control signal are at low levels, the second scanning signal is at a high level, the first transistor, the second transistor and the third transistor are turned on, the fourth transistor and the fifth transistor are turned off, the second preset power supply resets the storage capacitor through the third transistor, and the first preset power supply charges the storage capacitor through the first transistor; a writing compensation stage, in which the first scanning signal and the light emission control signal are at high levels, and the second scanning signal is at a low level, the first transistor, the second transistor, and the third transistor are turned off, the fourth transistor and the fifth transistor are turned on, the data signal is written into the gate electrode of the driving transistor through the fifth transistor, the storage capacitor is discharged through the driving transistor until the driving transistor is turned off; and a light emitting driving stage, in which the first scanning signal and the second scanning signal are both at high levels, and the light emission control signal is at a low level, the first transistor and the second transistor are turned on, the third transistor, the fourth transistor and the fifth transistor are turned off, the driving transistor generates a light emitting current under the action of the storage capacitor.

DETAILED DESCRIPTION

Figure 1:
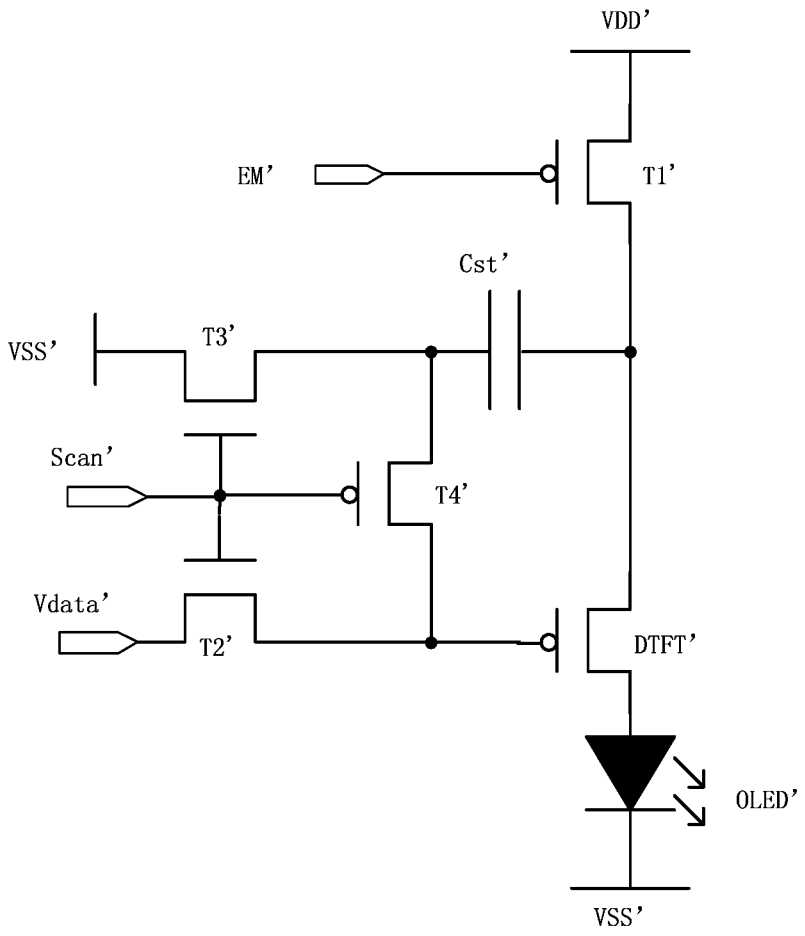
FIG. 1 is a schematic diagram of a pixel driving circuit in the related art.

Hereinafter, embodiments of the present disclosure will be described in detail. Examples of the embodiments are illustrated in the accompanying drawings, wherein the same or similar reference numerals denote the same or similar elements or elements having the same or similar functions throughout the figures. The embodiments described below with reference to the accompanying drawings are exemplary and are intended to explain the present disclosure, but should not be construed as limiting the present disclosure.

The pixel driving circuit in the related art will be briefly described below.

Figure 2:
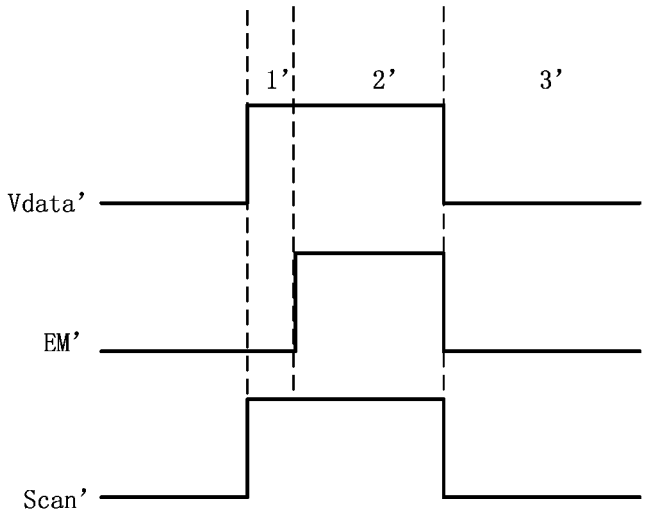
FIG. 2 is a control timing chart of a pixel driving circuit in the related art.

FIG. 1 is a schematic diagram of a pixel driving circuit in the related art. As shown in FIG. 1 and FIG. 2, the operation of the pixel driving circuit is as follows.

In stage 1': a scanning signal scan' is at a high level, a signal EM' is at a low level. At this time, transistors T1', T2', T3' in the pixel driving circuit are turned on, a transistor T4' is turned off, and preset power supplies VSS' and VDD' simultaneously charge a storage capacitor Cst'. A signal Vdata' is written to a gate electrode of a driving transistor DTFT'. A voltage across the storage capacitor Cst' is VDD'-VSS' when the stage 1' is completed.

In stage 2': the scanning signal scan' is still at a high level, the signal EM' is also at a high level. At this time, the transistors T1', T4' in the pixel driving circuit are turned off, T2', T3' are turned on, and the storage capacitor Cst' is discharged through the driving transistor DTFT' until the potential at one terminal of the storage capacitor Cst' connected to the driving transistor DTFT' drops to Vdata'+

|Vth'|, where Vth' is the threshold voltage of the driving transistor DTFT'. At this time, the driving transistor DTFT' is automatically turned off, and the compensation is completed.

In stage 3': the scanning signal scan' is at a low level and the signal EM' is at a low level. At this time, the transistors T1' and T4' in the pixel driving circuit are turned on, T2' and T3' are turned off, and the pixel emits light.

Although the above circuit solves the problem of display unevenness, since T1', T4', and DTFT' in the circuit are P-type transistors, and T2' and T3' are N-type transistors, the manufacturing process is complicated, and the cost is increased. While if T2', T3', and T4' are all changed to P-type TFTs, the gate electrodes of T2', T3', and T4' cannot share a single scanning signal Scan', and thus control signals have to be added to meet the requirements of the circuit, which will further complicate the design of the peripheral circuit.

It can be seen from the above that the pixel driving circuit of the related art either has a complicated process, or the control signals of the circuit are too complicated.

In view of this, embodiments of the present disclosure provide a pixel driving circuit, a display device, and an electronic device.

The pixel driving circuit, the display device and the electronic device according to the embodiments of the present disclosure are described below with reference to FIGS. 3 to 9.

Figure 3:
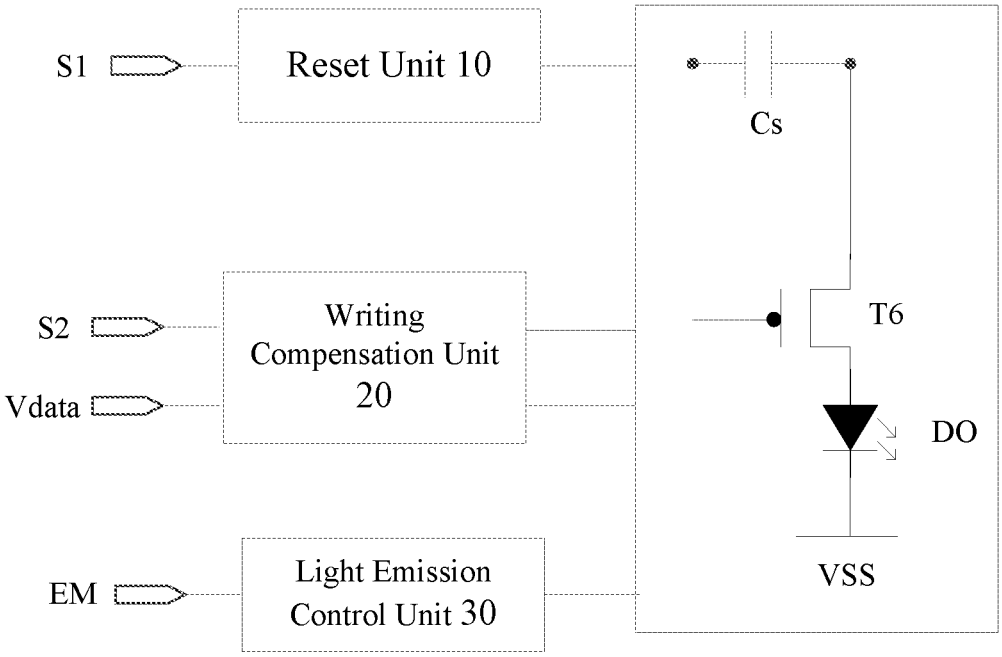
FIG. 3 is a block diagram of a pixel driving circuit according to an embodiment of the present disclosure.

FIG. 3 is a block diagram of a pixel driving circuit according to an embodiment of the present disclosure. As shown in FIG. 3, the pixel driving circuit 100 includes a driving transistor T6, a first scanning terminal S1, a second scanning terminal S2, a data input terminal Vdata, a light emission control terminal EM, a storage capacitor Cs, a reset unit 10, and a writing compensation unit 20 and a light emission control unit 30.

The storage capacitor Cs is connected to the driving transistor T6. The reset unit 10 is connected to the first scanning terminal S1. The reset unit 10 is turned on according to a first scanning signal provided by the first scanning terminal S1 to reset the storage capacitor Cs and charges the storage capacitor Cs. The writing compensation unit 20 is respectively connected to the second scanning terminal S2 and the data input terminal Vdata. The writing compensation unit 20 is turned on according to a second scanning signal provided by the second scanning terminal S2, to cause data signals provided by the data input terminal Vdata to be written into a gate electrode of the driving transistor T6, and to cause the storage capacitor Cs to be discharged through the writing compensation unit 20 and the driving transistor T6 until the driving transistor T6 is turned off. The light emission control unit 30 is connected to the light emission control terminal EM, and the light emission control unit 30 is turned on according to a light emission control signal provided by the light emission control terminal EM, to cooperate with the storage capacitor Cs to drive the driving transistor T6 to generate a light emitting current for driving the light emitting element DO in the pixel to emit light. The first scanning signal is outputted before the second scanning signal.

It should be noted that the pixel driving circuit 100 can be used to drive the pixels in the pixel array to emit light. That is, each pixel in the pixel array is connected to the corresponding pixel driving circuit 100, to emit light under the driving of the corresponding pixel driving circuit 100. As an example, the light emitting element DO of each pixel may be driven by the current generated when the driving transistor T6 is in a saturated state, that is, the current drives light emission.

In some embodiments of the present disclosure, the pixel array can adopt a row-by-row scanning method, that is, sequentially scanning one row after another. At this time, the previous row (for example, the $(n-1)^{th}$ row) is scanned first, and the current row (for example, the $n^{th}$ row) is scanned after that. The first scanning signal may be the scanning signal of the previous row, and the second scanning signal is the scanning signal of the current row.

Thus, when scanning the pixels of the current row, the scanning signal of the previous row is supplied to the reset unit 10 through the first scanning terminal S1, and the scanning signal of the current row is supplied to the writing compensation unit 20 through the second scanning terminal S2. The reset unit 10 may be turned on under the control of the scanning signal of the previous row. At this time, the reset unit 10 may reset the storage capacitor Cs and charge the storage capacitor Cs. In this way, with the scanning signal of the previous row, the pixel driving circuit 100 corresponding to each pixel of the current row may be reset and the storage capacitor Cs corresponding to each pixel of the current row may be charged.

After the reset unit 10 is turned off under the control of the scanning signal of the previous row, the writing compensation unit 20 may be turned on under the control of the scanning signal of the current row. At this time, the data signal provided by the data input terminal Vdata is written by the writing compensation unit 20 to the gate electrode of the driving transistor T6, to fix the potential of the gate electrode of the driving transistor T6. The storage capacitor Cs is discharged through the writing compensation unit 20 and the driving transistor T6 until the driving transistor T6 is turned off, thereby achieving threshold compensation of the driving transistor T6. In this way, with the scanning signal of the current row, the data signal is written into each pixel of the current row and the voltage threshold is compensated.

Before the writing compensation unit 20 is turned off under the control of the scanning signal of the current row, the light emission control unit 30 may be turned on under the control of the light emission control signal provided by the light emission control terminal EM. The light emission control unit 30 and the storage capacitor Cs jointly drive the driving transistor T6 to generate a light emitting current, to drive the light emitting element DO in the pixel to emit light.

Therefore, in the embodiment of the present disclosure, with the scanning signal of the previous row, the pixel driving circuit 100 may be reset and the storage capacitor Cs may be charged, and with the scanning signal of the current row, the data signal is written to fix the potential of the gate electrode of the driving transistor T6, and at the same time, the threshold compensation of the driving transistor T6 may be realized by self-discharge of the storage capacitor Cs through the driving transistor T6 until the driving transistor T6 is automatically turned off. In this way, the influence of the voltage threshold of the driving transistor T6 on the display evenness can be eliminated. The manufacturing process is simplified while the control signals for the circuit have been as simple as possible. In this way, the conflict between the complexity of manufacturing process and the complexity of control signals can be solved.

According to an embodiment of the present disclosure, the light emitting element DO may be a light emitting diode, for example, an organic light emitting diode.

The circuit structure and operation of the pixel driving circuit 100 according to an embodiment of the present disclosure are described below with reference to FIG. 4 to FIG. 9.

Figure 4:
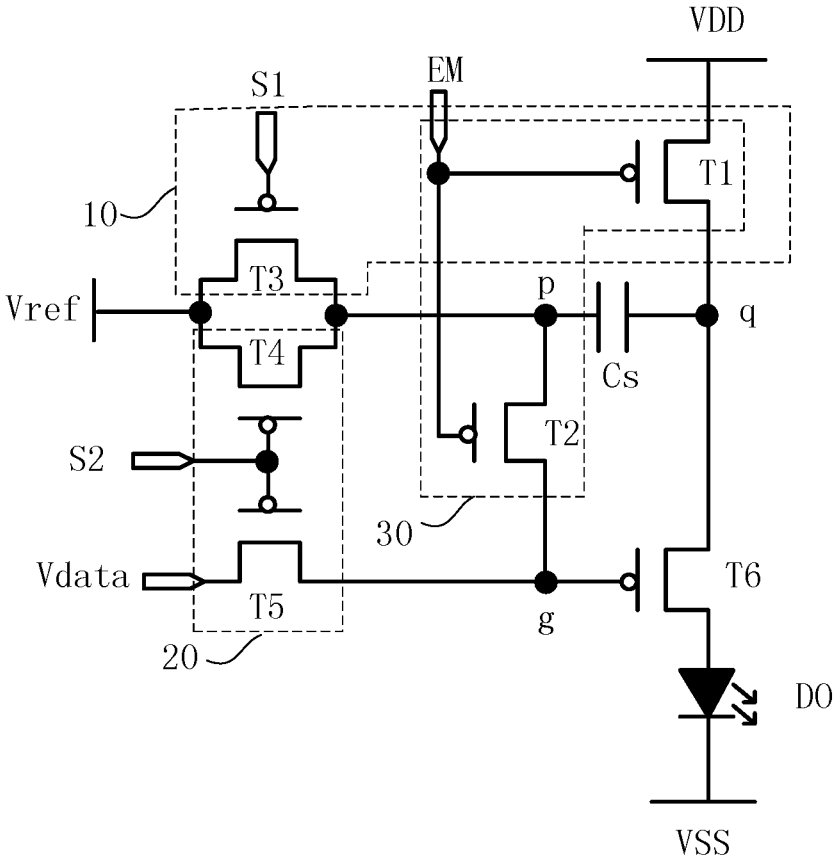
FIG. 4 is a schematic circuit diagram of a pixel driving circuit according to an embodiment of the present disclosure.

According to one embodiment of the present disclosure, as shown in FIG. 4, one terminal of the storage capacitor Cs is connected to the second electrode (for example, the source electrode) of the driving transistor T6. The light emission control unit 30 includes a first transistor T1 and a second transistor T2. The gate electrode of the first transistor T1 is connected to the light emission control terminal EM. The second electrode (for example, the source electrode) of the first transistor T1 is connected to a first preset power supply VDD. The first electrode (for example, the drain electrode) of the first transistor T1 is connected to the second electrode (for example, the source electrode) of the driving transistor T6. The gate electrode of the second transistor T2 is connected to the light emission control terminal EM. The first electrode (for example, the drain electrode) of the second transistor T2 is connected to the other terminal of the storage capacitor Cs. The second electrode (for example, the source electrode) of the second transistor T2 is connected to the gate electrode of the driving transistor T6.

The first electrode (for example, the drain electrode) of the first transistor T6 is connected to the anode of the light emitting device DO. The cathode of the light emitting device DO is connected to a third preset power supply VSS. The first preset power supply VDD may provide high-level voltage, and the third preset power supply VSS may provide low-level voltage.

According to an embodiment of the present disclosure, as shown in FIG. 4, the reset unit 10 shares the first transistor T1 with the light emission control unit 30. The reset unit 10 further includes a third transistor T3. The gate electrode of the third transistor T3 is connected to the first scanning terminal S1. The first electrode (for example, the drain electrode) of the third transistor T3 is connected to a second preset power supply Vref. The second electrode (for example, the source electrode) of the third transistor T3 is connected to one terminal of the storage capacitor Cs. The second preset power supply Vref may provide a reference level voltage which is lower than the high-level voltage.

According to an embodiment of the present disclosure, as shown in FIG. 4, the writing compensation unit 20 includes a fourth transistor T4 and a fifth transistor T5. The gate electrode of the fourth transistor T4 is connected to the second scanning terminal S2. The first electrode (for example, the drain electrode) of the fourth transistor T4 is connected to the second preset power supply Vref. The second electrode (for example, the source electrode) of the fourth transistor T4 is connected to one terminal of the storage capacitor Cs. The gate electrode of the fifth transistor T5 is connected to the second scanning terminal S2. The first electrode (for example, the drain electrode) of the fifth transistor T5 is connected to the data input terminal Vdata. The second electrode (for example, the source electrode) of the fifth transistor T5 is connected to the gate electrode of the driving transistor T6.

Each of the first transistor T1, the second transistor T2, the third transistor T3, the fourth transistor T4 and the fifth transistor T5 may be a P-type transistor. In addition, the driving transistor T6 may also be a P-type transistor. For example, each of the first transistor T1, the second transistor T2, the third transistor T3, the fourth transistor T4, the fifth transistor T5, and the driving transistor T6 may be a TFT (Thin Film Transistor) transistor.

According to an embodiment of the present disclosure, the value of the voltage level of the second preset power supply Vref is less than or equal to the minimum level of the data signal provided by the data input Vdata.

As described above, as shown in the embodiment of FIG. 4, the pixel driving circuit 100 of the embodiment of the present disclosure includes six transistors and one storage capacitor Cs. Each of T1 to T5 is a switching transistor and functions as a circuit switch. T6 is a driving transistor, and is for controlling the current to drive the light emitting element DO to emit light. In addition, the pixel driving circuit 100 uses three channels of control signals, i.e., a first scanning signal, a second scanning signal, and a light emission control signal.

It should be understood that, although the pixel driving circuit 100 of the embodiment of the present disclosure introduces three channels of control signals, the first scanning signal is actually the scanning signal of the previous row. Therefore, there are actually two channels of control signals inputted to the display device, which achieving the purpose of simplifying the control signals for the circuit.

With reference to the embodiment of FIG. 4, the operation stages of the pixel driving circuit 100 of the embodiment of the present disclosure may include the following in sequence: a reset stage, a writing compensation stage, and a light emission driving stage. Further, a buffering stage D3 may be further included between the writing compensation stage D2 and the light emission driving stage D4. The following describes an example in which the first scanning signal is the scanning signal S(n−1) of the previous row, the second scanning signal is the scanning signal S(n) of the current row, the light emission control signal is the light emission control signal EM(n) of the current row.

Figure 5:
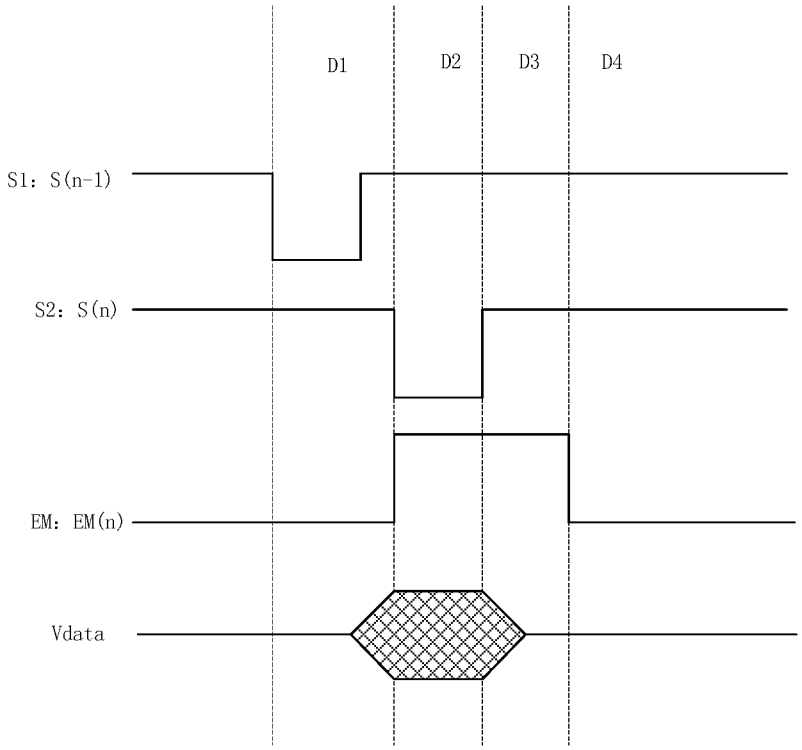
FIG. 5 is a control timing chart of a pixel driving circuit according to an embodiment of the present disclosure.
Figure 6:
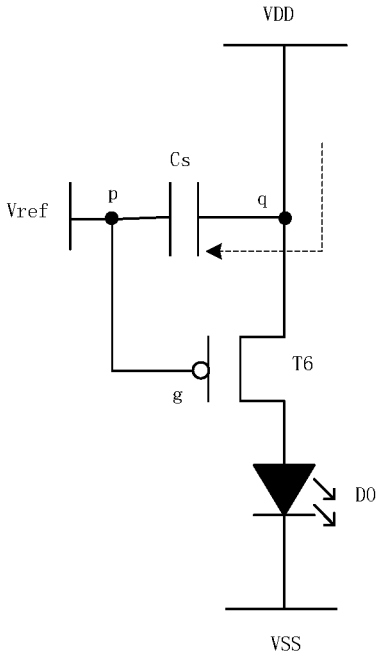
FIG. 6 is an equivalent circuit diagram of a pixel driving circuit in a reset stage according to an embodiment of the present disclosure.

As shown in FIG. 5 and FIG. 6, in the reset stage D1, the first scanning signal and the light emission control signal are at low levels, the second scanning signal is at a high level, the first transistor T1, the second transistor T2 and the third transistor T3 are turned on, the fourth transistor T4 and the fifth transistor T5 are turned off, the second preset power supply Vref resets the storage capacitor Cs through the third transistor T3, and the first preset power supply VDD charges the storage capacitor Cs through the first transistor T1.

That is, in the reset stage D1, the scanning signal S(n−1) of the previous row and the light emission control signal EM(n) of the current row are at low levels, and the scanning signal S(n) of the current row is at a high level.

In this stage, the low-level scanning signal S(n−1) of the previous row is supplied to the gate electrode of the third transistor T3 through the first scanning terminal S1. The third transistor T3 is turned on under the driving of the low level voltage. The low-level light emission control signal EM(n) of the current row is supplied to the gate electrodes of the first transistor T1 and the second transistor T2 through the light emission control terminal EM. The first transistor T1 and the second transistor T2 are turned on under the driving of the low level voltage. At the same time, the high-level scanning signal S(n) of the current row is supplied to the gate electrodes of the fourth transistor T4 and the fifth transistor T5 through the second scanning terminal S2. The fourth transistor T4 and the fifth transistor T5 are turned off under the driving of the high level voltage. The equivalent circuit diagram is shown in FIG. 6.

Since the first transistor T1, the second transistor T2, and the third transistor T3 are turned on, the reference level of the second preset power supply Vref reaches a point p (that is, the other terminal of the storage capacitor Cs) and a point g (that is, the gate electrode of the driving transistor T6)

through the third transistor T3, to clear and reset the data of the previous stage. At the same time, the high level voltage of the first preset power supply VDD charges the storage capacitor Cs through the first transistor T1. At the end of the reset stage D1, the voltage difference across the storage capacitor Cs may be: VDD-Vref.

Figure 7:
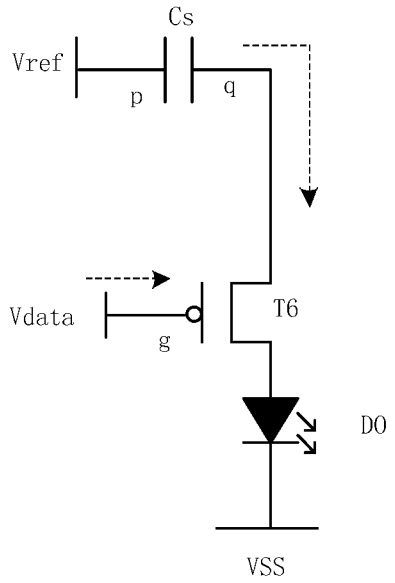
FIG. 7 is an equivalent circuit diagram of a pixel driving circuit in a writing compensation stage according to an embodiment of the present disclosure.

As shown in FIG. 5 and FIG. 7, in the writing compensation stage D2, the first scanning signal and the light emission control signal are at high levels, and the second scanning signal is at a low level. The first transistor T1, the second transistor T2, and the third transistor T3 are turned off. The fourth transistor T4 and the fifth transistor T5 are turned on. The data signal is written into the gate electrode of the driving transistor T6 through the fifth transistor T5. The storage capacitor Cs is discharged through the driving transistor T6 until the driving transistor T6 is turned off.

That is, in the writing compensation stage D2, the scanning signal S(n−1) of the previous row and the light emission control signal EM(n) of the current row are at high levels, and the scanning signal S(n) of the current row is at a low level.

In this stage, the high-level scanning signal S(n−1) of the previous row is supplied to the gate electrode of the third transistor T3 through the first scanning terminal S1. The third transistor T3 is turned off under the driving of the high level voltage. The high-level light emission control signal EM(n) of the current row is supplied to the gate electrodes of the first transistor T1 and the second transistor T2 through the light emission control terminal EM. The first transistor T1 and the second transistor T2 are turned off under the driving of the high level voltage. At the same time, the low-level scanning signal S(n) of the current row is supplied to the gate electrodes of the fourth transistor T4 and the fifth transistor T5 through the second scanning terminal S2. The fourth transistor T4 and the fifth transistor T5 are turned on under the driving of the low level voltage. The equivalent circuit diagram is shown in FIG. 7.

Due to the fourth transistor T4 and the fifth transistor T5, the other terminal of the storage capacitor Cs is still connected to the second preset power supply Vref. Although one terminal of the storage capacitor Cs is already disconnected from the first preset power supply VDD, the potential is still at the high level of the first preset power supply VDD. At the same time, the data signal is written into the gate electrode (i.e. the point g) of the driving transistor T6 through the fifth transistor T5. Since the data voltage Vdata is lower than the high level of the first preset power supply VDD, the driving transistor T6 is not turned off. Starting from this stage, the storage capacitor Cs discharges to the low potential of the third preset power source VSS through the driving transistor T6 (but the generated current is not enough to drive the light emitting element DO to emit light). The potential at one terminal (i.e. the point q) of the storage capacitor Cs begins to decrease continuously until the potential drops to the sum of the absolute value of the voltage Vdata of the data signal and the threshold voltage, i.e., Vdata+|Vthd|, where Vthd is the threshold voltage of the driving transistor T6. At this time, the driving transistor T6 is automatically turned off. At the end of the writing compensation stage D2, the voltage difference across the storage capacitor Cs is Vdata+|Vthd|−Vref.

It should be noted that, in the writing compensation stage D2, the falling edge of the second scanning signal and the rising edge of the light emission control signal are simultaneously provided to the second scanning terminal S2 and the light emission control terminal EM. That is, when the external control signal is input, the falling edge of the scanning signal S(n) of the current row and the rising edge of the light emission control signal EM(n) of the current row should be aligned.

It should also be noted that the falling edge of the second scanning signal and the rising edge of the first scanning signal need not be provided to the second scanning terminal S2 and the first scanning terminal S1 at the same time. That is, the rising edge of the scanning signal S(n−1) of the previous row and the falling edge of the scanning signal S(n) of the current row may not be aligned.

Figure 8:
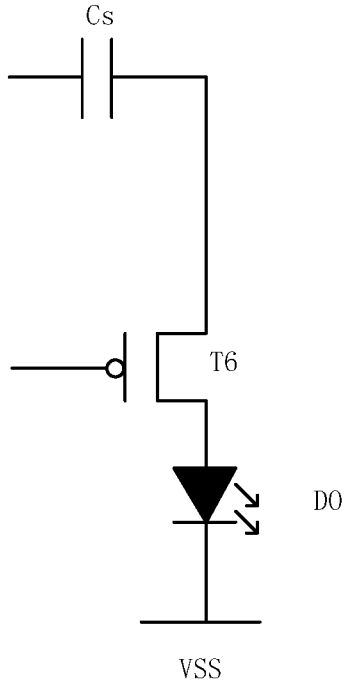
FIG. 8 is an equivalent circuit diagram of a pixel driving circuit in a buffering stage according to an embodiment of the present disclosure.

As shown in FIG. 5 and FIG. 8, in the buffering stage D3, the first scanning signal, the second scanning signal, and the light emission control signal are all at high levels, and the first transistor T1, the second transistor T2, the third transistor T3, the fourth transistor T4 and the fifth transistor T5 are all turned off to suppress interference.

That is, in the buffering stage D3, the scanning signal S(n−1) of the previous row, the light emission control signal EM(n) of the current row, and the scanning signal S(n) of the current row are all at high levels.

In this stage, the high-level scanning signal S(n−1) of the previous row is supplied to the gate electrode of the third transistor T3 through the first scanning terminal S1. The third transistor T3 is turned off under the driving of the high level voltage. The high-level light emission control signal EM(n) of the current row is supplied to the gate electrodes of the first transistor T1 and second transistor T2 through the light emission control terminal EM. The first transistor T1 and second transistor T2 are turned off under the high level voltage. At the same time the high-level scanning signal S(n) of the current row is supplied to the gate electrodes of the fourth transistor T4 and the fifth transistor T5 through the second scanning terminal S2. The fourth transistor T4 and the fifth transistor T5 are turned off under the driving of the high level voltage. The equivalent circuit diagram is shown in FIG. 8.

The first transistor T1, the second transistor T2, the third transistor T3, the fourth transistor T4, and the fifth transistor T5 are all turned off to avoid unnecessary noise.

Figure 9:
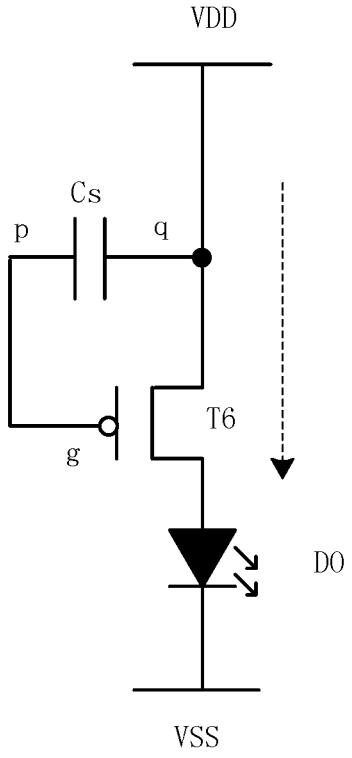
FIG. 9 is an equivalent circuit diagram of a pixel driving circuit in a light emission control stage according to an embodiment of the present disclosure.

As shown in FIG. 5 and FIG. 9, in the light emitting driving stage D4, the first scanning signal and the second scanning signal are both at high levels, and the light emission control signal is at a low level. The first transistor T1 and the second transistor T2 are turned on. The third transistor T3, the fourth transistor T4 and the fifth transistor T5 are turned off. The driving transistor T6 generates a light emitting current under the action of the storage capacitor Cs.

That is, in the light emitting driving stage D4, the scanning signal S(n−1) of the previous row and scanning signal S(n) of the current row are at high levels, and the light emission control signal EM(n) of the current row is at a low level.

In this stage, the high-level scanning signal S(n−1) of the previous row is supplied to the gate electrode of the third transistor T3 through the first scanning terminal S1. The third transistor T3 is turned off under the driving of the high level voltage. The high-level scanning signal S(n) of the current row is supplied to the gate electrodes of the fourth transistor T4 and the fifth transistor T5 through the second scanning terminal S2, and the fourth transistor T4 and the fifth transistor T5 are turned off under the driving of the high level voltage. At the same time, the low-level light emission control signal EM(n) of the current row is supplied to the gate electrodes of the first transistor T1 and the second transistor T2 through the light emission control terminal EM, and the first transistor T1 and the second transistor T2 are turned on under the driving of the low level voltage. The equivalent circuit diagram is shown in FIG. 9.

Since the second transistor T2 is turned on, the other terminal of the storage capacitor Cs is actually connected to the gate electrode of the driving transistor T6, and the gate electrode of the driving transistor T6 is floating at point g. Therefore, the voltage Vsg between the source electrode and the gate electrode of the driving transistor T6 is the voltage difference VCs (that is, VCs=Vdata+|Vthd|−Vref) across the storage capacitor Cs at the end of the writing compensation stage D2. Also, since the voltage Vsd between the source electrode and the drain electrode of the driving transistor T6 is larger than the difference between the voltage Vsg between the source electrode and the gate electrode of the driving transistor T6 and the threshold voltage of the driving transistor T6, that is, Vsd>Vsg−|Vthd|, the driving transistor T6 operates in a saturated state. Therefore, the light emitting current Ioled generated by the driving transistor T6 is:

$$Ioled=K\times(Vsg-|Vthd|)^2=K\times(VCs-|Vthd|)^2=K\times(Vdata+|Vthd|-Vref-|Vthd|)^2=K\times(Vdata-Vref)^2$$

Where K is a constant value related to the process and the design.

As can be seen from the above equation, the light emission current Ioled supplied to the light emitting element DO such as the organic light emitting diode is only related to the voltage Vdata of the data signal and the reference voltage Vref of the second preset power supply, and independent of the threshold voltage Vthd of the driving transistor T6. Thus, it can eliminate the influence of the voltage threshold of the driving transistor T6 on the display evenness. In addition, the first transistor T1, the second transistor T2, the third transistor T3, the fourth transistor T4, the fifth transistor T5, and the driving transistor T6 in the embodiment of the present disclosure are all P-type transistors. The simple manufacturing process can be ensured while simple control signals for the circuit can be maintained as far as possible since there are actually two channels of control signals inputted.

Accordingly, according to the pixel driving circuit provided by the embodiment of the present disclosure, the reset unit is turned on according to the first scanning signal provided by the first scanning terminal to reset the storage capacitor and charge the storage capacitor. The writing compensation unit is turned on according to the second scanning signal provided by the second scanning terminal, to cause the data signals provided by the data input terminal to be written into the gate electrode of the driving transistor and to cause the storage capacitor to be discharged through the writing compensation unit and the driving transistor until the driving transistor is turned off. The light emitting control unit is turned on according to a light emitting control signal provided by the light emitting control terminal, to drive the driving transistor together with the storage capacitor, to generate a light emitting current for driving the light emitting element in the pixel to emit light. Further, the first scanning signal is outputted before the second scanning signal. Therefore, it can eliminate the influence of the voltage threshold of the driving transistor on the display evenness. The simple manufacturing process can be ensured while simple control signals for the circuit can be maintained as far as possible.

In addition, an embodiment of the present disclosure further provides a display panel including the pixel driving circuit of the above embodiment.

According to the display panel provided by the embodiment of the present disclosure, it can eliminate the influence of the voltage threshold of the driving transistor on the display evenness. The simple manufacturing process can be ensured while simple control signals for the circuit can be maintained as far as possible.

Finally, an embodiment of the present disclosure further provides a display device including the display panel of the above embodiment.

According to the display device provided by the embodiments of the present disclosure, it can eliminate the influence of the voltage threshold of the driving transistor on the display evenness. The simple manufacturing process can be ensured while simple control signals for the circuit can be maintained as far as possible.

In the description of the present disclosure, it is to be understood that a position or positional relationship indicated by the terms "center", "longitudinal", "transverse", "length", "width", "thickness", "up", "down", "front", "rear", "left", "right", "vertical", "horizontal", "top", "bottom", "inner", "outer", "clockwise", "counterclockwise", "axial", "radial", "circumferential", etc. is based on the orientation or positional relationship shown in the drawings, and is merely for convenience of describing the present disclosure and simplification of the description, rather than indicating or implying that the pointed device or element must have the specific orientation and configured or operated in the specific orientation. Therefore it cannot be construed as a limitation of the present disclosure.

Furthermore, the terms "first" and "second" are used for descriptive purposes only, and are not to be construed as indicating or implying relative importance or implicitly indicating the number of indicated technical features. Thus, features defined as "first", "second" may explicitly or implicitly include at least one such feature. In the description of the present disclosure, the meaning of "plurality" is at least two, such as two, three, etc., unless specifically and specifically defined otherwise.

In the present disclosure, the terms "mounting", "coupling", "connecting", "securing" and the like should be understood in a broad sense unless specifically defined or limited. For example, it may be a fixed connection or a detachable connection, or integrated; it can be mechanical or electrical connection; it can be directly connected, or indirectly connected through an intermediate element; it can be internal communication of two components or interaction between the two components, unless otherwise expressly limited. Those of ordinary skill in the art may understand the specific meanings of the above terms in the present disclosure according to specific circumstances.

In the present disclosure, unless specifically stated and defined otherwise, a first feature being "above" or "below" a second feature may be a direct contact between the first and second features, or the first and second features contacting each other indirectly through an intermediate element. Also, a first feature being "over", "on" or "above" a second feature may be the first feature being right on the second feature or diagonally above the second feature, or simply indicate that the first feature is higher than the second feature in height. The first feature being "below", "under" and "lower than" the second feature may be the first feature being right below or diagonally below the second feature, or may merely indicate that the first feature level is lower than the second feature in height.

In the description of the present specification, the description referring to the terms "one embodiment", "some embodiments", "an example", "a specific example", or "some examples" or the like means a specific feature, structure, material, or characteristic described in conjunction with the embodiment or example is included in at least one embodiment or example of the present disclosure. In this specification, the schematic representation of the above terms does not necessarily have to refer to the same embodiment or example. Furthermore, the particular feature, structure, material, or characteristic described may be combined in any suitable manner in any one or more of the embodiments or examples. In addition, those skilled in the art may incorporate and combine the different embodiments or examples described in this specification and features of different embodiments or examples without conflicting with each other.

According to the display device provided by the embodiments of the present disclosure, the influence of the voltage threshold of the driving transistor on the display evenness can be eliminated. The simple manufacturing process can be ensured while simple control signals for the circuit can be maintained as far as possible.

Although the embodiments of the present disclosure have been illustrated and described above, it is to be understood that the above embodiments are exemplary and not to be construed as limiting the present disclosure. Those skilled in the art may, within the scope of the present disclosure, make changes, modifications, substitutions and variations to the above embodiments.

What is claimed is:

1. A pixel driving circuit, comprising a driving transistor, a first scanning terminal, a second scanning terminal, a data input terminal, a light emission control terminal, a storage capacitor, a reset unit, a writing compensation unit, and a light emission control unit, wherein, the storage capacitor is connected to the driving transistor;

the reset unit is connected to the first scanning terminal, and the reset unit is turned on according to a first scanning signal provided by the first scanning terminal, to reset the storage capacitor and charge the storage capacitor;

the writing compensation unit is respectively connected to the second scanning terminal and the data input terminal, and the writing compensation unit is turned on according to a second scanning signal provided by the second scanning terminal, to cause data signals provided by the data input terminal to be written into a gate electrode of the driving transistor, and to cause the storage capacitor to be discharged through the writing compensation unit and the driving transistor until the driving transistor is turned off;

the light emission control unit is connected to the light emission control terminal, the light emission control unit is turned on according to a light emission control signal provided by the light emission control terminal, to cooperate with the storage capacitor to drive the driving transistor to generate a light emitting current for driving the light emitting element in the pixel to emit light; and wherein the first scanning signal is outputted before the second scanning signal.

2. The pixel driving circuit according to claim 1, wherein one terminal of the storage capacitor is connected to the second electrode of the driving transistor, and the light emission control unit comprises a first transistor and a second transistor, a gate electrode of the first transistor is connected to the light emission control terminal, a second electrode of the first transistor is connected to a first preset power supply, and a first electrode of the first transistor is connected to a second electrode of the driving transistor, a gate electrode of the second transistor is connected to the light emission control terminal, a first electrode of the second transistor is connected to the other terminal of the storage capacitor, and a second electrode of the second transistor is connected to the gate electrode of the driving transistor.

3. The pixel driving circuit according to claim 2, wherein the reset unit shares the first transistor with the light emission control unit, the reset unit further comprises a third transistor, a gate electrode of the third transistor is connected to the first scanning terminal, a first electrode of the third transistor is connected to a second preset power supply, and a second electrode of the third transistor is connected to one terminal of the storage capacitor.

4. The pixel driving circuit according to claim 3, wherein the writing compensation unit includes a fourth transistor and a fifth transistor, a gate electrode of the fourth transistor is connected to the second scanning terminal, a first electrode of the fourth transistor is connected to the second preset power supply, a second electrode of the fourth transistor is connected to one terminal of the storage capacitor, a gate electrode of the fifth transistor is connected to the second scanning terminal, a fifth electrode of the fifth transistor is connected to the data input terminal, and a second electrode of the fifth transistor is connected to the gate electrode of the driving transistor.

5. The pixel driving circuit according to claim 4, wherein each of the first transistor, the second transistor, the third transistor, the fourth transistor, and the fifth transistor is a P-type transistor.

6. The pixel driving circuit according to claim 4, wherein operation stages of the pixel driving circuit sequentially comprises a reset stage, a writing compensation stage, and a light emitting driving stage, wherein in the reset stage, the first scanning signal and the light emission control signal are at low levels and the second scanning signal is at a high level, the first transistor, the second transistor and the third transistor are turned on, the fourth transistor and the fifth transistor are turned off, the second preset power supply resets the storage capacitor through the third transistor, and the first preset power supply charges the storage capacitor through the first transistor;

in the writing compensation stage, the first scanning signal and the light emission control signal are at high levels, the second scanning signal is at a low level, the first transistor, the second transistor, and the third transistor are turned off, the fourth transistor and the fifth transistor are turned on, the data signal is written into the gate electrode of the driving transistor through the fifth transistor, and the storage capacitor is discharged through the driving transistor until the driving transistor is turned off; and in the light emitting driving stage, the first scanning signal and the second scanning signal are at high levels, and the light emission control signal is at a low level, the first transistor and the second transistor are turned on, the third transistor, the fourth transistor and the fifth transistor are turned off, and the driving transistor generates the light emitting current under the action of the storage capacitor.

7. The pixel driving circuit according to claim 6, wherein the operation stages further comprises a buffering stage between the writing compensation stage and the light emitting driving stage, wherein in the buffering stage, the first scanning signal, the second scanning signal, and the light emission control signal are at high levels, and the first transistor, the second transistor, the third transistor, the fourth transistor and the fifth transistor are turned off to suppress interference.

8. The pixel driving circuit according to claim 6, wherein in the writing compensation stage, a falling edge of the second scanning signal and a rising edge of the light emission control signal are simultaneously provided to the second scanning terminal and light emission control terminal.

9. A display panel comprising the pixel driving circuit according to claim 1.

10. A display device comprising the display panel according to claim 9.

11. A method for driving a pixel with the pixel driving circuit of claim 4 comprising:

a reset stage, in which the first scanning signal and the light emission control signal are at low levels, the second scanning signal is at a high level, the first transistor, the second transistor and the third transistor are turned on, the fourth transistor and the fifth transistor are turned off, the second preset power supply resets the storage capacitor through the third transistor, and the first preset power supply charges the storage capacitor through the first transistor;

a writing compensation stage, in which the first scanning signal and the light emission control signal are at high levels, and the second scanning signal is at a low level, the first transistor, the second transistor, and the third transistor are turned off, the fourth transistor and the fifth transistor are turned on, the data signal is written into the gate electrode of the driving transistor through the fifth transistor, the storage capacitor is discharged through the driving transistor until the driving transistor is turned off; and a light emitting driving stage, in which the first scanning signal and the second scanning signal are both at high levels, and the light emission control signal is at a low level, the first transistor and the second transistor are turned on, the third transistor, the fourth transistor and the fifth transistor are turned off, the driving transistor generates a light emitting current under the action of the storage capacitor.

12. The method according to claim 11, further comprising a buffering stage between the writing compensation stage and the light emitting driving stage, wherein in the buffering stage, the first scanning signal, the second scanning signal, and the light emission control signal are at high levels, and the first transistor, the second transistor, the third transistor, the fourth transistor and the fifth transistor are turned off to suppress interference.

13. The method of claim 11, wherein in the writing compensation stage, a falling edge of the second scanning signal and a rising edge of the light emission control signal are simultaneously provided to the second scanning terminal and light emission control terminal.

* * * * *